United States Patent [19]

Navarro

[11] Patent Number: 4,693,524

[45] Date of Patent: Sep. 15, 1987

[54] COMPONENT ELEMENTS FOR BUILDING FURNITURE

[76] Inventor: Vicente N. Navarro, Pl. Eduardo Marquina, 18 -26a, 46014, *Valencia, Spain*

[21] Appl. No.: 686,746

[22] Filed: Dec. 27, 1984

[30] Foreign Application Priority Data

Dec. 27, 1983 [ES] Spain ..... 276.569

[51] Int. Cl.[4] ..... A47B 47/00

[52] U.S. Cl. ..... 312/140; 312/257 SK; 108/159

[58] Field of Search ..... 312/140, 108, 111, 257 SK, 312/263, 264, 265; 108/157, 159

[56] References Cited

U.S. PATENT DOCUMENTS

| | | | |
|---|---|---|---|
| 891,143 | 6/1908 | Burns | 108/159 |
| 2,365,622 | 12/1944 | Bockius | 312/108 |
| 2,904,360 | 9/1959 | Gamlen | 312/140 |
| 2,942,924 | 6/1960 | Stangert | 312/140 |
| 3,044,656 | 7/1962 | Combs et al. | 312/257 SK |
| 3,087,768 | 4/1963 | Anderson et al. | 312/257 SK |
| 3,276,832 | 10/1966 | Reilly | 312/140 |
| 3,736,035 | 5/1973 | Brown et al. | 312/257 SK |
| 3,880,095 | 4/1975 | Clark et al. | 312/257 SK |
| 4,126,364 | 11/1978 | Reilly | 312/140 |
| 4,291,928 | 9/1981 | Kiyosawa | 312/140 |
| 4,468,067 | 8/1984 | Jenkins | 312/140 |

FOREIGN PATENT DOCUMENTS

| | | | |
|---|---|---|---|
| 2632818 | 2/1977 | Fed. Rep. of Germany | 312/140 |
| 12230 | 12/1967 | Japan | 312/140 |
| 86467 | 6/1936 | Switzerland | 312/140 |
| 1015580 | 1/1966 | United Kingdom | 312/111 |

*Primary Examiner*—Victor N. Sakran

*Attorney, Agent, or Firm*—Marks Murase & White

[57] ABSTRACT

The present invention discloses component elements for building any desired furniture structure comprising vertical columns having orifices for receipt of fasteners, such as screws and horizontal support members that are connected to the vertical columns. The horizontal supports have a body portion with orifices that communicate with the column orifices for passage of a fastener therethrough. The horizontal supports also have at least one support end portion projecting from the body portion and a rib projecting from the support member generally perpendicular to the body and the end portions. Other horizontal support embodiments are shown, suitable for constructing shelves or display cases.

11 Claims, 12 Drawing Figures

A
B
1
2
3
5

1
2
3

A-B
1
5

C
D
1
2
3
4
5
7
8
23

C-D
1
3
4
5
6
23

COMPONENT ELEMENTS FOR BUILDING FURNITURE

BACKGROUND OF THE INVENTION

This invention refers to new modular components which permit the formation of furniture pieces of many shapes and features and which are based on joining elements which remain the same in all cases, which elements together with other joining pieces can be used to construct a number of furniture items, such as tables, chairs, cocktail tables, shelving, displays, TV carts, serving trays, beds, and generally all other types of furniture. The invention has several practical and economic advantages which both reduce the costs of the furniture thus obtained and result in structural and componential characteristics which are significantly different from any other type of means now in use for furniture components.

SUMMARY OF THE INVENTION

The invention features component elements for building furniture including vertical columns having a plurality of orifices adapted to receive a fastening member. The invention also features at horizontal support members connected to the vertical columns having a support body portion containing orifices that communicate with the vertical column orifices. The support body portion has at least one support end portion projecting from the body portion and a rib projecting from the support member generally perpendicular to the body portion and the support end portion.

One embodiment of the horizontal support member has a first body face for mating with the vertical column and a pair of end portions projecting from the support body at a 45 degree angle relative to the body face, and a finger member attached to each body portion end and projecting therefrom. By attaching tubular frames to opposed finger members on separate horizontal supports, horizontal frames can be constructed in any desired furniture shape or application.

The vertical columns supporting the assembly and bearing the various attached frames, obtained in accordance with the foregoing paragraphs, can be made of acrylic metal, wood or any other material with suitable characteristics; the height can vary, depending on the furniture being built, by attaching the columns to the horizontal supports of superimposed horizontal frames by means of screws from the inside part of the support member. Any combination of elements may be utilized to derive a desired finished furniture piece.

To build shelving and displays there are certain additional horizontal support member embodiments, the ends of which have a 45 degree shape, its central section being sufficiently long depending on the distance in the furniture piece between the angular columns descending from the sides, presenting in said layers either one, two or more widened horizontal orifices in the section descending from the angled profile; in the middle of these widened orifices is a smaller opening or port so that when assembling the furniture, the additional piece will be joined from its upper part to the screws that are partially threaded to the vertical columns of the angles, attaching it to the screws by a simple downward pressure, and it is enough to push the screws down completely once the support has been joined for it to remain stable and capable of supporting the shelving.

The joining pieces used inside display cases, like those mentioned in the foregoing paragraph, will have an angled profile, but the ends will comprise a pair of body portions of different lengths or extremes, yet capable of connecting in all instances with the sides of the furniture piece and of being attached independently between front and rear vertical columns, the corresponding widened horizontal orifices with smaller ports leading to the screws attached to the columns for assembly, the front fold or layer being shorter and ending with a 135 degree angle cut relative to its body face to permit opening of the display case door without blocking it, while the rear body portion is longer, having a 45 degree angle cut relative to its body face, the rear one serving to support and hold the rear board of the display case, remaining between the aforementioned side and the lower plane of the vertical column making up the support of the furniture piece, the length of the central section of the support pieces being variable in all cases, as well as the joining profiles between the imbedded pieces, depending on the furniture being built.

For a clearer understanding of the general characteristics exposed above, we have attached three sheets which graphically represent one form of embodiment of the modular components to form furniture pieces which make up the object of this invention; since the drawings are presented only by way of clarification, they are not in any way limiting in scope.

BRIEF DESCRIPTION OF THE DRAWINGS

The figures in the three attached sheets of drawings represent the following.

DESCRIPTION OF THE PREFERRED EMBODIMENTS

Still with reference to the attached drawings, we can see that in the figures presented in same there are numbers corresponding to the descriptions of the characteristics and operation provided here below for easy identification, -1- being the first embodiment of horizontal support pieces to be applied to the angles of the various furniture items to be obtained, which pieces -1- have a right angle shape, the ends of which have projecting fingers -2-, at 90 degrees from one another, the central part of which have a 45 degree bevel, on the external side of which will be joined and attached vertical columns -4- which may vary in height and make up. The horizontal supports -1- have a projecting element or rib -5- on the internal side of bevel -3-, which serves as a support for boards -6-, shelves, or other pieces required to build the furniture item.

Horizontal supports -1- will be used to make up horizontal frames of various sizes to build multipurpose furniture items, where tubes -7- will house projecting finger -2-, leaving a central opening -8- circumscribed by the frame where boards -6- can be joined. The boards can be of wood, glass or plastic, and may remain simply resting on the projecting ribs -5- or duly screwed thereto.

Figure 1:
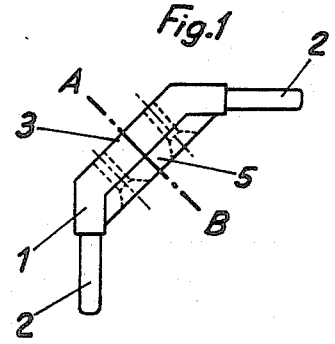
FIG. 1: A plan view of one embodiment of horizontal support members there being a pair of projecting fingers at right angles relative to each other, there being a rib to support boards and similar items on the inside angle starting at the bevel.
Figure 2:
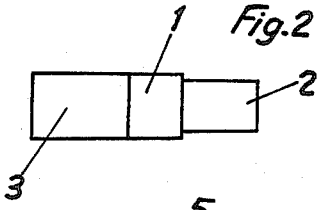
FIG. 2: Lateral view in elevation of the piece in FIG. 1.
Figure 3:
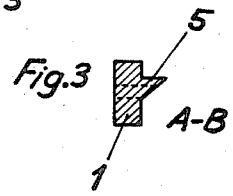
FIG. 3: Section A–B, in elevation, of FIG. 1, showing the position of the projecting rib and the lower position of the screws to assemble the furniture piece.
Figure 4:
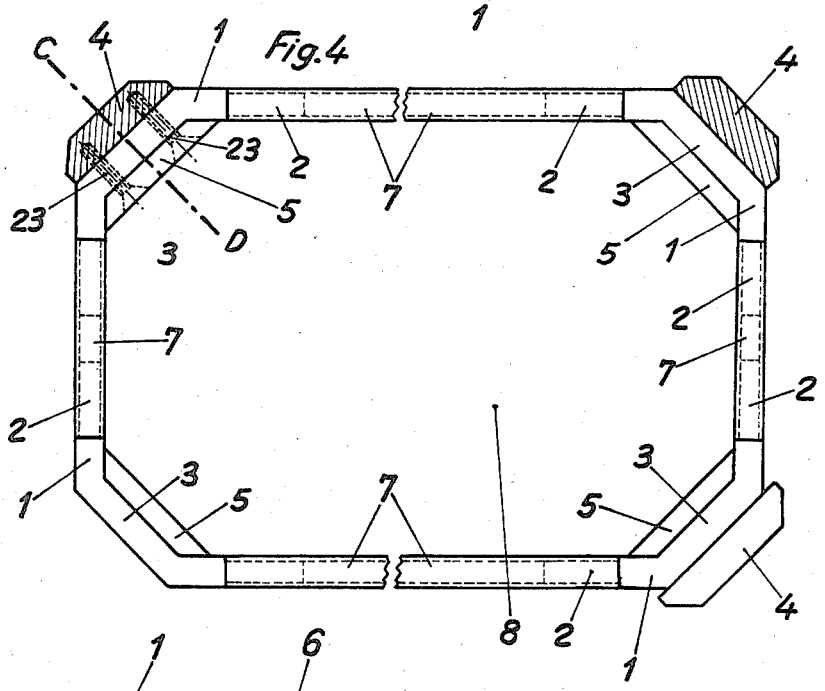
FIG. 4: Conventional plan drawing of the manner of assembling the support members of FIG. 1 using tubular joining profiles, vertical columns being incorporated into the angles, which may be of different materials and of different dimensions, to form the screwed on furniture piece.
Figure 5:
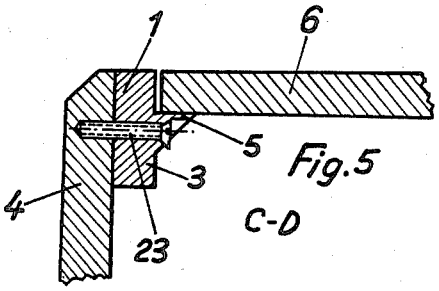
FIG. 5: Section C–D, in elevation, of FIG. 4, showing the manner of assembling the horizontal supports to the vertical columns, as well as the superimposed placement of a board resting on the projecting rib of the imbedded piece.
Figure 6:
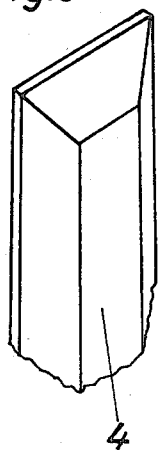
FIG. 6: Detail in perspective of one upper end, corresponding to one of the vertical columns, which can be applied to and mounted on horizontal support in FIG. 1, permitting any geometric form to be adopted.
Figure 7:
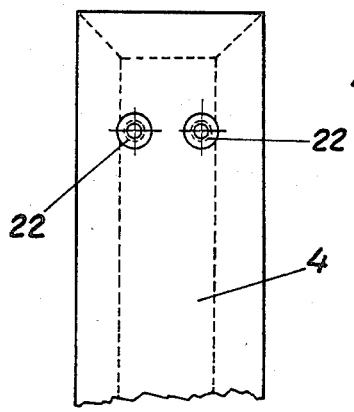
FIG. 7: Interior frontal view, in elevation, of the upper end of one of the vertical columns, showing the placement of two coupled caps to be attached to the imbedded angle piece by means of screws, whether these caps are used or not is dictated by the material of which the columns is made.
Figure 8:
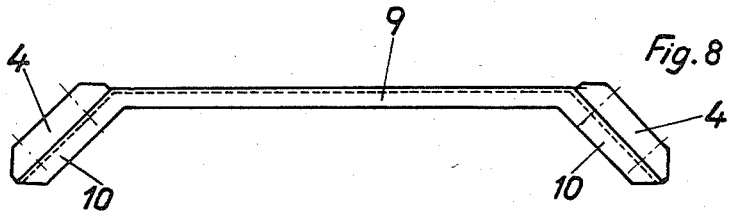
FIG. 8: Drawing of another embodiment of a horizontal support member to make shelving, constructed by an angular profile, perferably of metal, and being attached at the end pair of body portions to the vertical columns by means of screws.
Figure 9:
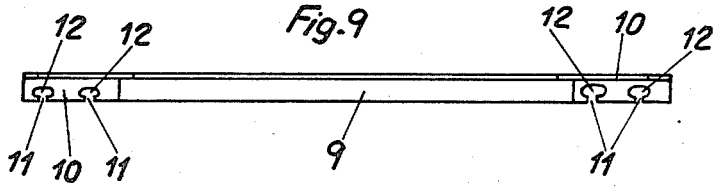
FIG. 9: Elevation view of the profile making up the piece in FIG. 8, the body portions on the ends presenting widened horizontal orifices with a smaller opening to be joined to the screws attached in the vertical columns by applying pressure subsequently.
Figure 10:
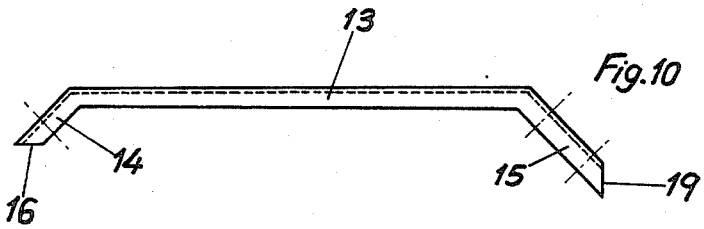
FIG. 10: Plan view of another horizontal support embodiment that is helpful for building display cases, applied to the sides of same, showing a pair of body portions at each end one shorter than the other in order to position it joined to the display case door, ending in a right angle cut to prevent interference with the door, while the other body portion, also terminating in a right angle, constitutes the support for the rear board of the display case itself.
Figure 11:
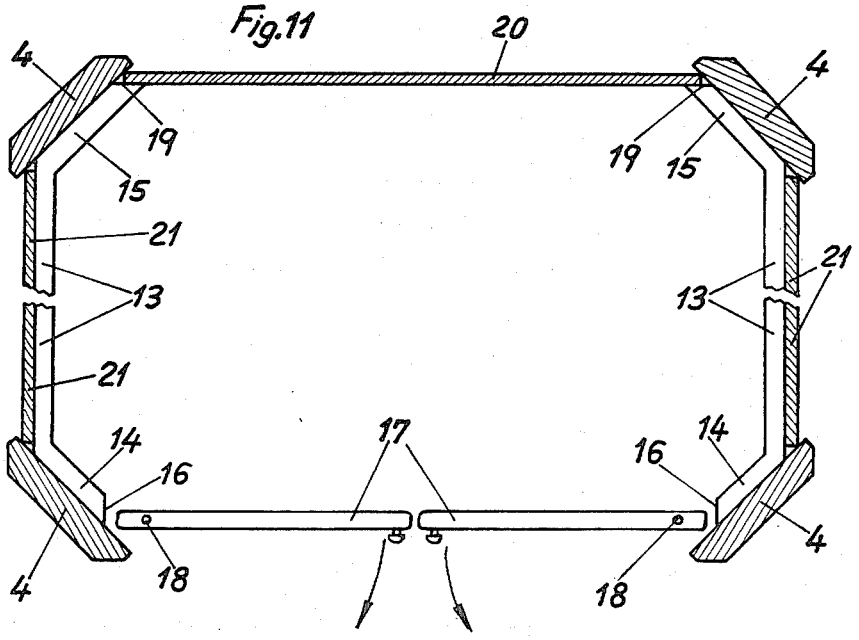
FIG. 11: Sectional view of a display case, equipped with the component elements we have described, showing the position of the doors, the lateral and rear boards, as well as the additional support pieces of same which are mounted on the vertical columns of the ends.
Figure 12:
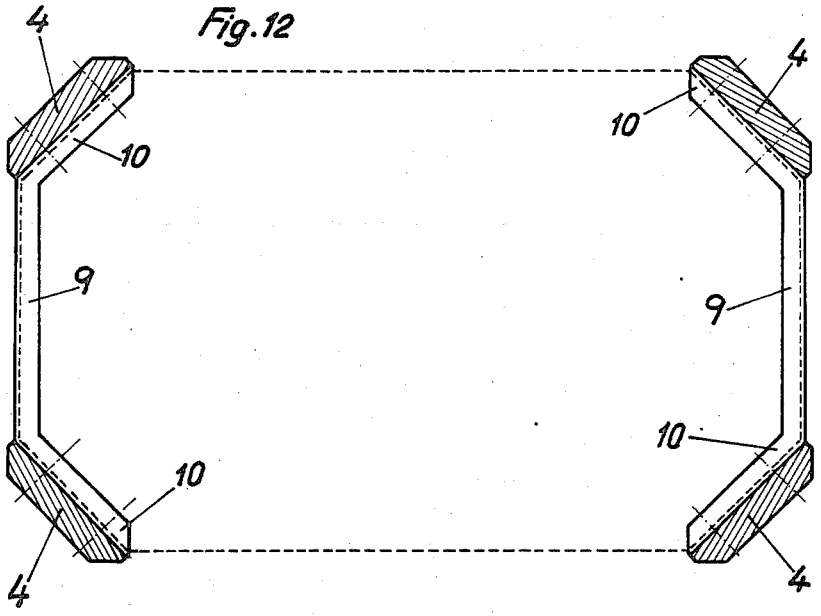
FIG. 12: Sectional view of shelving equipped with the horizontal support pieces represented in FIG. 8.

To form shelving other than the frames described in the foregoing paragraph, which make up the furniture item jointly with columns -4-, there are additional embodiment of horizontal supports pieces -9- which serve to support the shelves, which pieces -9- as shown in FIG. 8 are angle shaped, and their ends -10- are each body portions that form a 45 degree bend relative to each other on the two sides of the commonly shared end portion therebetween so that said ends -10- are joined on columns -4-, attached by screws. The screws are inserted through a lower open slot defined by the body portion -11- as shown in FIG. 9, remaining lodged inside widened horizontal orifices -12- located on end bends -10- of the support pieces and in order to attach them permanently it is sufficient to push the screws threaded in the vertical columns down as far as they will go.

Where display cases are concerned, the formation of the shelves will be along additional horizontal support pieces -13- as shown in FIG. 11 with an angle profile, preferably of metal, which pieces have a bend on their extremes, so that the front body portion front -14- is shorter than rear body portion -15-, front body portion -14- ending in an angle cut -16- of 135 degrees relative to the body portion so that when a door -17- of the display case moves at hinge point -18- there is no interference with the support, while rear body portion -15-, which is longer, also ends in an angle -19- of 45 degrees relative to the body portion, to hold and support rear board -20- of the display case, leaving lateral boards -21- attached between display case support pieces -13- and vertical columns -4- of the corners.

Vertical columns -4- may be made of wood, acrylic, metal or any other material of appropriate characteristics. In any material which does not offer sufficient retention for screw threads threaded caps -22-, appropriately filled, will be added to attach screws -23- thereto to allow affixation of imbedded pieces -1- or supports -9- and -13- to columns -4-.

Having given a description of all and each of the parts making up the component elements to build furniture which are the object of this invention, it is noted to those skilled in the art that the different parts may be of various materials, shapes and sizes, and that constructional variations may be designed within the scope of the present invention.

What is claimed is:

1. Component elements for building furniture comprising:

a vertical column having a plurality of column orifices adapted to receive a fastening member;

a horizontal support member connected to said vertical column, said horizontal support member including:

a support body portion, a plurality of body orifices disposed in said support body portion and positioned to align with said column orifices, support end portion means projecting from said support body portion, a rib means projecting from said horizontal support member in a direction generally perpendicular to said vertical column;

wherein said horizontal support member has first and second support body portions adapted to be connected to first and second vertical columns, respectively, said first and second support body portions being spaced at an angle relative to each other and connected to each other by a common support end, both of said body portions having a plurality of said body orifices defined therein.

2. The component elements as recited in claim 1 wherein said first and second body portions are spaced relative to each other at a forty-five degree angle.

3. The component elements recited in claim 1 wherein said rib projects from said first and second body portions and said support ends.

4. The component elements as recited in claim 3 wherein said first and second body portions each have a body face for mating with first and second vertical columns, respectively; and wherein said first body portion terminates at a forty-five degree angle relative to said first vertical column and said second body portion terminates at a one hundred thirty-five degree angle relative to said second vertical column.

5. The component elements as recited in claim 4 wherein at least one of said vertical columns and a horizontal support member attached thereto define a gap therebetween and a panel is interposed in said gap.

6. Component elements for building furniture comprising:

a vertical column having a plurality of column orifices adapted to receive a fastening member;

a horizontal support member connected to said vertical column, said horizontal support member including:

a support body portion, a plurality of body orifices disposed in said support body portion and positioned to align with said column orifices, suppport end portion means projecting from said support body portion, a rib means projecting from said horizontal support member in a direction generally perpendicular to said vertical column;

wherein said vertical column has a first column face for mating with said horizontal support member, and a second column face generally parallel to said first column face, having a pair of parallel bevelled edges oriented at a forty-five degree angle relative to said first column face; and wherein said horizontal support member has a first body face for mating with said first column face and said support end portions project from said body portion at forty-five degree angles relative to said first body face.

7. The component elements as recited in claim 6 wherein said horizontal support member body has a first body face for mating with said first column face, a second body face generally parallel to said first body face, a lower body edge abutting said first and second body faces, having a slot in communication with one of said body orifices, said body orifices having a bevelled edge along said second body face.

8. Component elements for building furniture comprising:

a vertical column having a plurality of column orifices adapted to receive a fastening member;

a horizontal support member connected to said vertical column, said horizontal support member including:

a support body portion, a plurality of body orifices disposed in said support body portion and positioned to align with said column orifices, support end portion means projecting from said support body portion, a rib means projecting from said horizontal support member in a direction generally perpendicular to said vertical column;

wherein said horizontal support member has a first body face on said body, a second body face on said body generally parallel to said first body face, a pair of support end portion means projecting toward said second body face at forty-five degree angles relative to said first body face, and a finger member attached to each body end portion and projecting therefrom.

9. The component elements as recited in claim 8, further comprising a tubular member; and wherein four columns are spaced so as to substantially form a rectangle, each column having a horizontal support member attached thereto so that each finger member of each horizontal support lies along a plane in opposed relationship with a finger member of another of said horizontal supports and each pair of opposed finger members are inserted into ends of said tubular member so as to form a generally rectangular tubular structure which connects said four columns to each other.

10. Component elements for building furniture comprising:

a vertical column having a plurality of column orifices disposed along a vertical extent thereof and adapted to receive a fastening member;

a horizontal support member connected to said vertical column, said horizontal support member including:

a support body portion, a plurality of body orifices disposed in said support body portion and positioned to align with said column orifices, support end portion means projecting from said support body portion, said support end portion means operable to interconnect adjacent horizontal support members and a shelf supporting rib projecting from said horizontal support member in a direction generally perpendicular to said vertical column.

11. Component elements for building furniture comprising:

a vertical column having a mating face and an orifice therein;

a horizontal support member having a first, complimentary face with respect to the mating face of said vertical column and an orifice therein positioned to align with the orifice of said vertical column, and a second face, generally parallel to said first face, said horizontal support member further having first and second end portions projecting therefrom at an angle with respect to said first face and a shelf-supporting flange extending generally perpendicular from said second face;

an elongated connection member having first and second ends, the ends of said connecting member being operable to interfit with the projecting end portions of said horizontal support member whereby said connecting member is operable to link.opposing projecting end portions of any adjacent horizontal support members; and fastening means for fastening said horizontal support member to said vertical column by means of said aligned orifices.

* * * * *